United States Patent [19]

Van Steenwyk et al.

[11] 4,197,654

[45] Apr. 15, 1980

[54] SURVEY APPARATUS AND METHOD EMPLOYING ALL LATITUDE, ALL ATTITUDE GYROCOMPASSING

[75] Inventors: Donald H. Van Steenwyk, San Marino; John R. Cash; Paul W. Ott, both of Pasadena, all of Calif.

[73] Assignee: Applied Technologies Associates, San Marino, Calif.

[21] Appl. No.: 924,931

[22] Filed: Jul. 17, 1978

[51] Int. Cl.[2] ..... E21B 47/024; G01C 19/38

[52] U.S. Cl. ..... 33/304; 33/321; 33/324

[58] Field of Search ..... 33/304, 324, 321

[56] References Cited

U.S. PATENT DOCUMENTS

| | | | |
|---|---|---|---|
| 3,308,670 | 3/1967 | Granqvist | 33/321 |
| 3,753,296 | 8/1973 | Van Steenwyk | 33/304 |
| 3,894,341 | 7/1975 | Kapeller | 33/324 |

*Primary Examiner*—Steven L. Stephan
*Attorney, Agent, or Firm*—William W. Haefliger

[57] ABSTRACT

Survey apparatus and method employs one or more rate gyroscopes having spin axis components directed along an instrument travel axis and in also in directions normal to the travel axis, so that when the gyroscope or gyroscopes are rotated, the earth's rate of rotation will be detected, at all latitudes and at all instrument attitudes.

24 Claims, 22 Drawing Figures

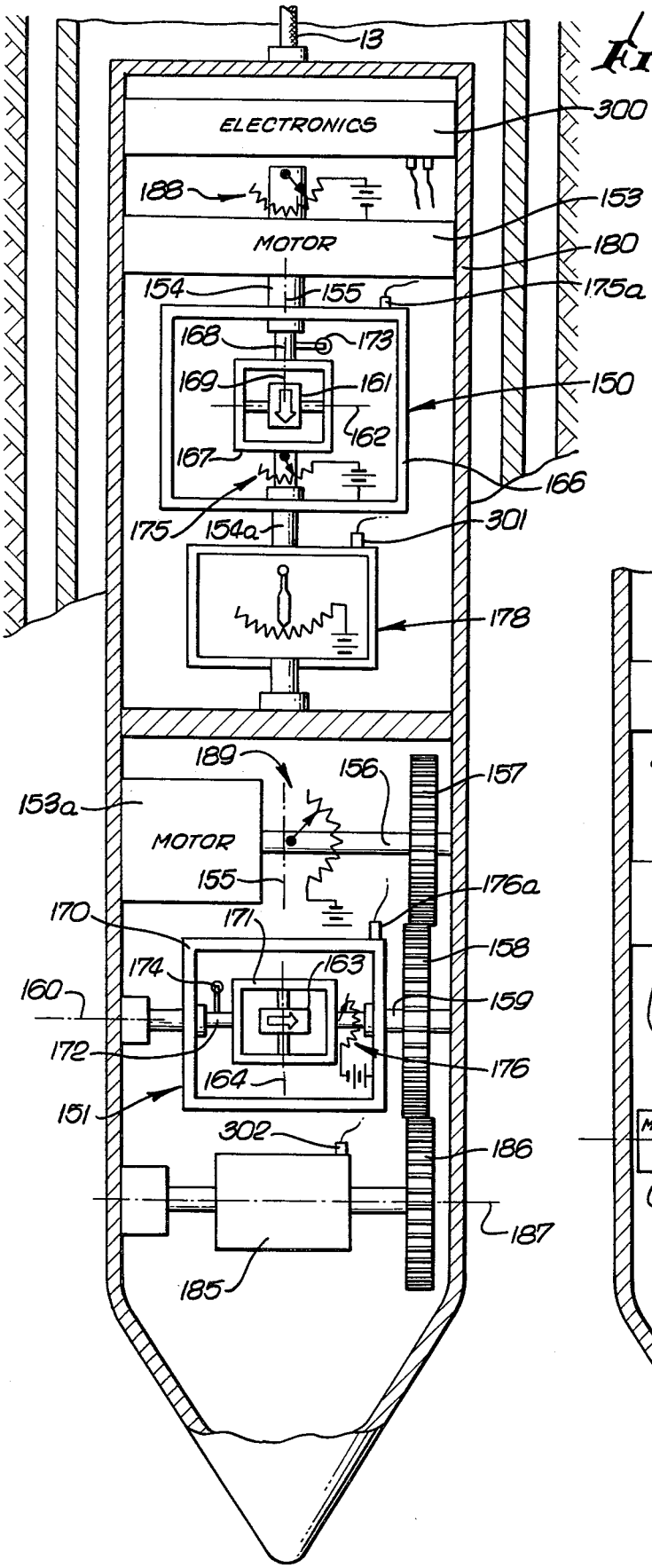
FIG. 6.
FIG. 8.
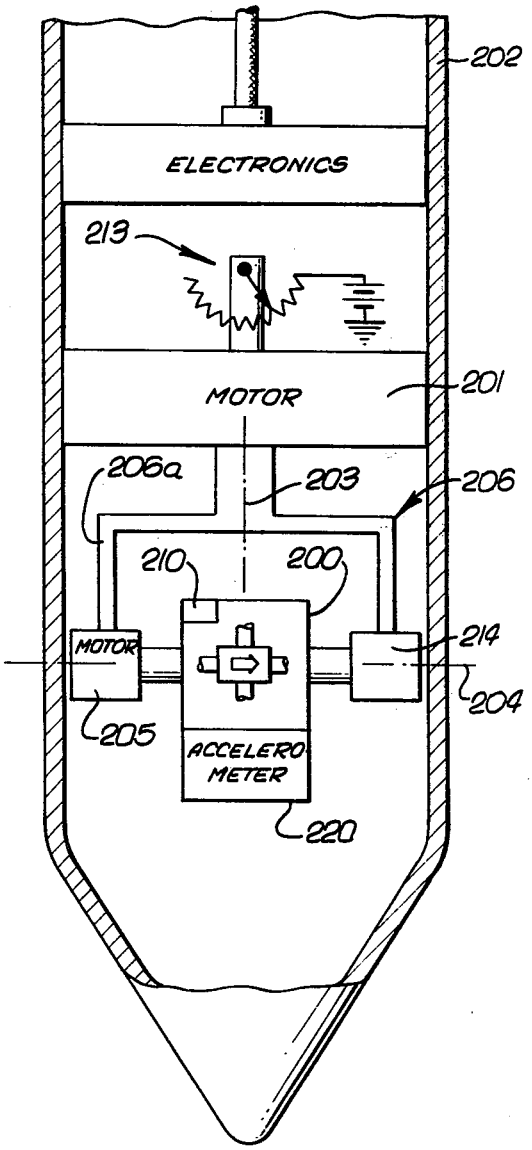

SURVEY APPARATUS AND METHOD EMPLOYING ALL LATITUDE, ALL ATTITUDE GYROCOMPASSING

BACKGROUND OF THE INVENTION

This invention relates generally to bore-hole and well mapping, and more particularly concerns method and apparatus to remotely determine the azimuthal direction of a probe, which may for example be inserted into a bore-hole or well. In addition, it concerns method and apparatus to determine the probe's degree of tilt from vertical and to relate the latter to gyroscope generated azimuth information, at all latitudes and at all instrument attitudes. Further, the azimuth determining apparatus by itself or in combination with the tilt measuring apparatus, may be housed in a carrier of sufficiently small diameter to permit insertion directly into available small I.D. drill tubing, thus eliminating the need to remove the tubing to enable such mapping.

In the past, the task of position mapping a well or bore-hole for azimuth in addition to tilt has been excessively complicated, very expensive, and often inaccurate because of the difficulty in accommodating the size and special requirements of the available instrumentation. For example, magnetic compass devices typically require that the drill tubing be pulled from the hole and fitted with a length of non-magnetic tubing close to the drill head; or, the drill stem may be fitted with a few tubular sections of non-magnetic material, either initially or when drill bits are changed. The magnetic compass device is inserted within this non-magnetic section and the entire drill stem reassembled and run back in the hole as measurement are made. Thereafter, the magnetic compass instrumentation package must again be removed, requiring another round trip of the drill string. These devices are very inaccurate where drilling goes through magnetic materials, and are unusable where casing has been installed.

Directional or free gyroscopes are deployed much as the magnetic compass devices and function by attempting to remember a pre-set direction in space as they are run in the hole. Their ability to remember degrades with time and environmental exposure. Also, their accuracy is reduced as instrument size is reduced, as for example becomes necessary for small well bores. Further, the range of tilt and azimuthal variations over which they can be used is restricted by gimbal freedom which must be limited to prevent gimbal lock and consequent gyro tumbling.

A major advance toward overcoming these problems is described in my U.S. Pat. No. 3,753,296. That invention provides a method and means for overcoming the above complications, problems, and limitations by employing that kind and principal of a gyroscope known as rate-of-turn gyroscope, or commonly 'a rate gyro', to remotely determine a plane containing the earth's spin axis (azimuth) while inserted in a bore hole or well. The rate gyroscope has a rotor defining a spin axis; and means to support the gyroscope for travel in a bore-hole and to rotate about another axis extending in the direction of the hole, the gyroscope characterized as producing an output which varies as a function of azimuth orientation of the gyroscope relative to the earth's spin axis. Such means typically includes a carrier containing the gyroscope and a motor, the carrier being sized for travel in the well, as for example within the drill tubing. Also, circuitry is operatively connected with the motor and carrier to produce an output signal indicating azimuthal orientation of the rotating gyroscope relative to the carrier, whereby that signal and the gyroscope output may be processed to determine azimuth orientation of the carrier and any other instrument therein relative to the earth's spin axis, such instrument for example comprising a well logging device such as a radiometer, inclinometer, etc.

While highly accurate azimuth information is obtainable from the device and method of U.S. Pat. No. 3,753,296, certain problems can present themselves depending upon the bore-hole direction relative to the earth's spin axis.

Consider for example the case of a vertical bore-hole at or near the North pole. Since the travel axis of the instrument or navigator is parallel to the earth's spin axis, the navigator gimbal would rotate and its gyro's input axis would remain in a plane perpendicular to ESA (Earth Spin Axis) and would not detect earth's rate of rotation. Likewise, the accelerometer would have a zero output signal since its sensitive axis remains at right angles to the direction of gravity. This unique case at or near the earth's poles is repeated at lower latitudes, where for example the bore-hole is slanted to approach a parallel relation with ESA. As in the earlier example, the gyro's input axis is rotated in a plane perpendicular to earth's spin vector, and thus there is no output resulting from gyroscopic forces. An instrument mass unbalance error, or any uncertainty of $\pm$ one degree of rotation per hour, under these circumstances can not be differentiated from a bore-hole or instrument travel axis misalignment with ESA of about 4 degrees. In addition, since there is so little signal (due to earth's rotation) being detected, such uncertainties amplify their effects in the ability to define North. In applicant's standard scheme of using gyro-accelerometer signals for instance, such a $\pm 1°$/hour uncertainty would result in at least a $\pm 50°$ to 60° North error at 5 degrees inclination from ESA. With a 10° inclination from ESA, a $\pm 1°$/hour uncertainty would result in a $\pm 20°$ error in North.

SUMMARY OF THE INVENTION

It is a major object of the invention to provide method and means to produce rotor spin axis components directed not only along the instrument travel axis (the bore-hole axis), but also along an axis or axes normal to the travel axis, as will appear, one or more rate gyros being employed for this purpose as will be seen. In one form of the invention, the rate gyro is "canted", or angularly misaligned, relative to the instrument travel axis, such that the gyroscope axis describes a conical surface when slowly rotated by the drive motor.

In another form of the invention, dual rate gyroscopes are employed, one gyroscope mounted as in U.S. Pat. No. 3,753,296 to be motor rotated about the instrument travel axis, and the second gyroscope mounted to the motor rotated about another axis normal to the travel axis. Advantages of this configuration include:

A. Achieves a truly all attitude, all latitude gyrocompass instrument whose accuracy will not degrade below about half what it is under most ideal attitude and latitude circumstances.

B. Provides redundancy for data confirmation and for data gathering in event of a gyrocompass failure.

C. Helps in a more accurate solution of mass unbalance determination by providing two independent readouts that relate to each other where their planes of input axis rotation intersect.

A third form of the invention employs only one rate-of-turn gyroscope, whose operation can result in achievement of the above advantages A and C. As will appear, the gyro input axis is swung or rotated either in a plane containing the instrument axis (travel axis), or in a plane normal to that axis.

Broadly considered, the method of the invention concerns mapping a remote zone and using the steps:

(a) suspending at said zone a rate of turn gyroscope means having spin rotor means with spin axis components along first and second orthogonal axes, the gyroscope means having carrier frame means, (b) and selectively rotating the carrier frame means about said axes and in conjunction with rotation of the spin rotor means to produce a signal or signals indicative of azimuth orientation of at least one of said spin axis components relative to the earth's spin axis.

Another aspect of the invention involves the method of operating an instrument as described. Consider again the example initially described wherein the instrument is traveled in a bore-hole generally parallel to the earth's spin axis, the gyroscope is slowly rotated, and no output signal is produced. The very fact that there is no output signal from gyroscopic forces is a means of identifying North. A ±1 degree per hour uncertainty under this method would amount to only a 4 or 5 degree error. Therefore a change from the conventional method of determining North to this 'identification by lack of signal' technique becomes worth while at bore-hole angles below 12–15 degrees from ESA. With uncertainties lower than 18 degrees, this angle would be lower, and with higher uncertainties this angle would be higher.

These and other objects and advantages of the invention, as well as the details of illustrative embodiment, will be more fully understood from the following description and drawings, in which:

DRAWING DESCRIPTION

Figure 1:
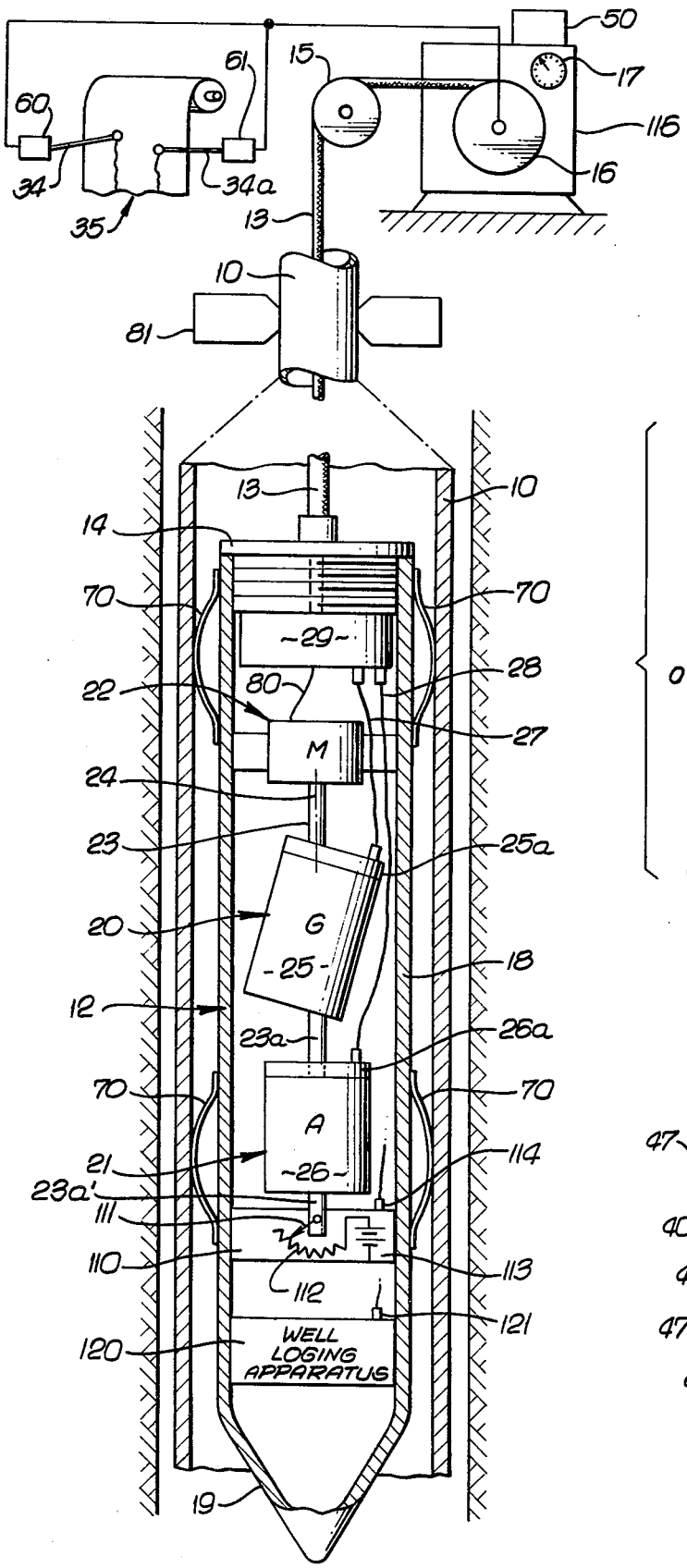
FIG. 1 is an elevation taken in section to show use of one form of instrument of the invention, in well mapping.
Figure 5:
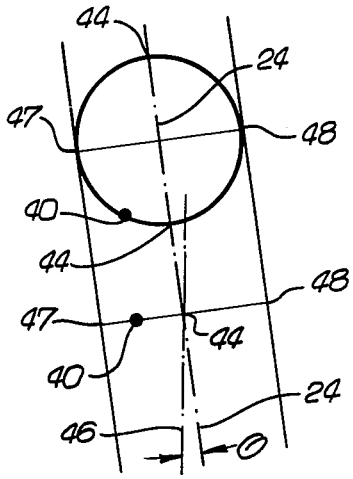
Figure 4:
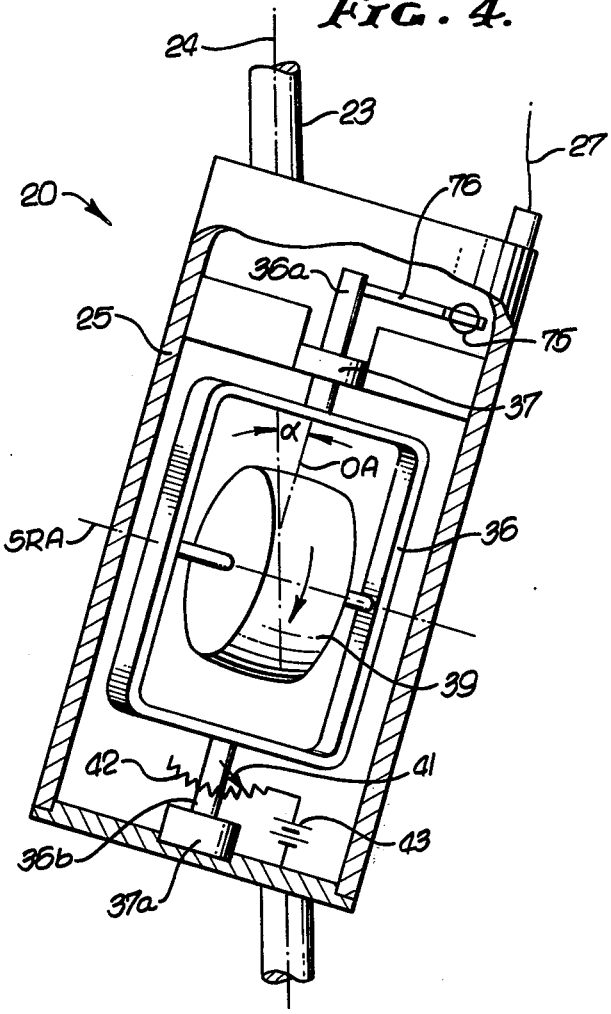
Figure 4B:
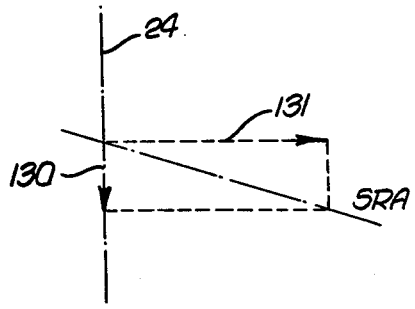
Figure 7:
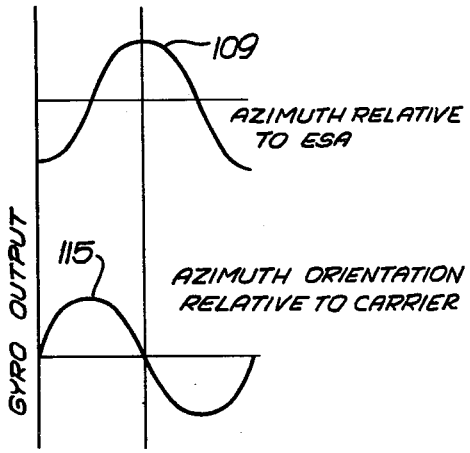
Figure 4A:
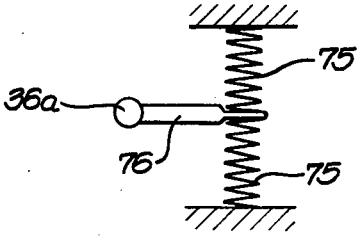
Figure 9A:
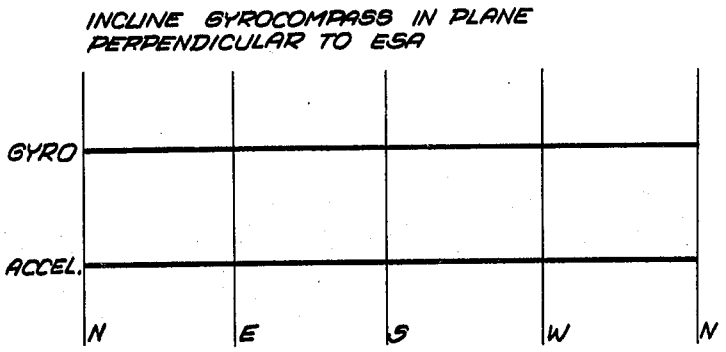
Figure 9B:
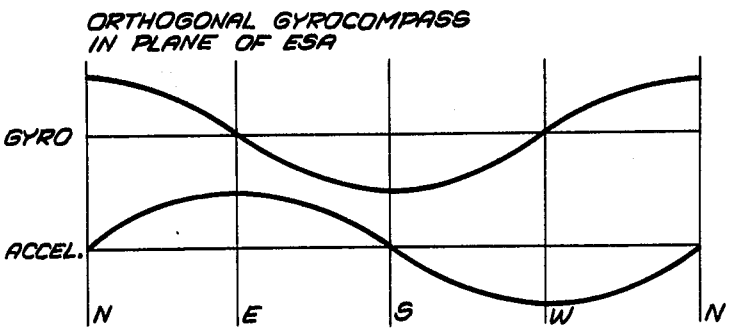
Figure 9C:
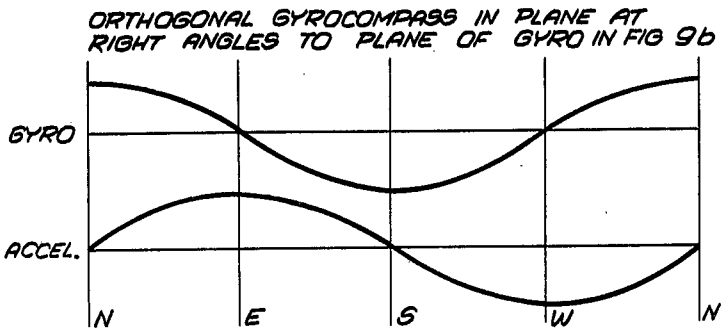
Figure 9:
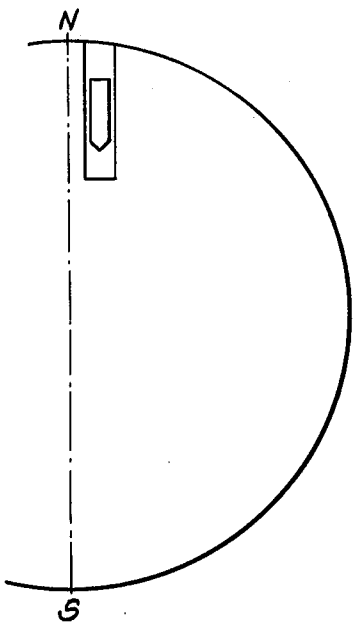
Figure 10A:
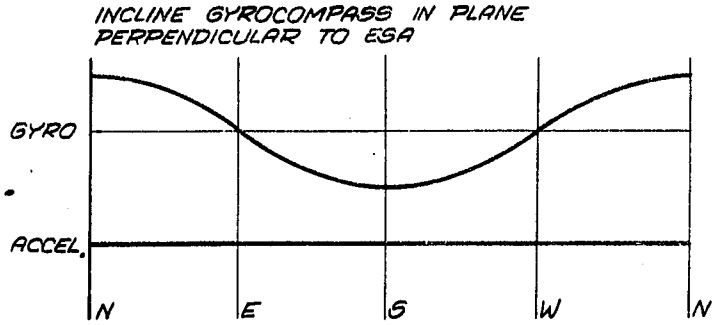
Figure 10B:
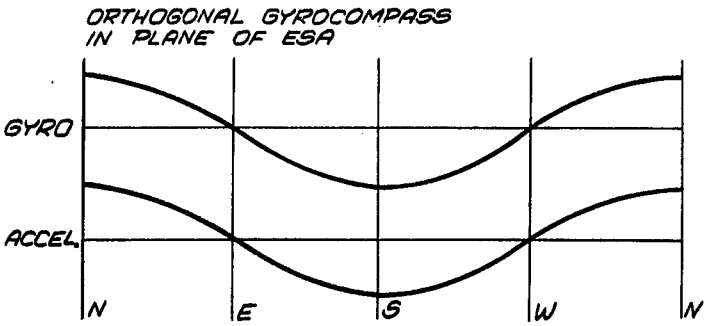
Figure 10C:
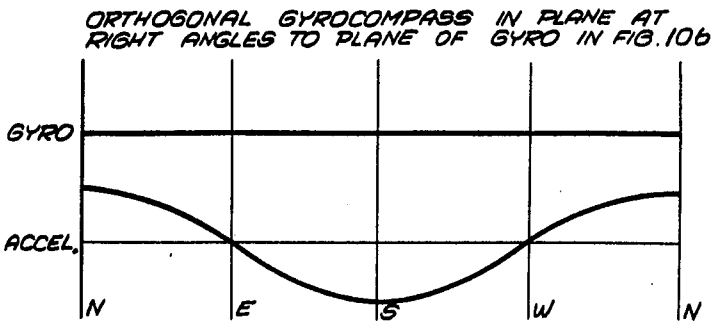
Figure 10:
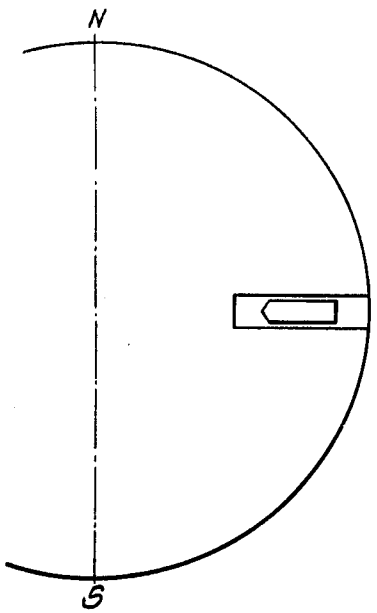
Figure 11A:
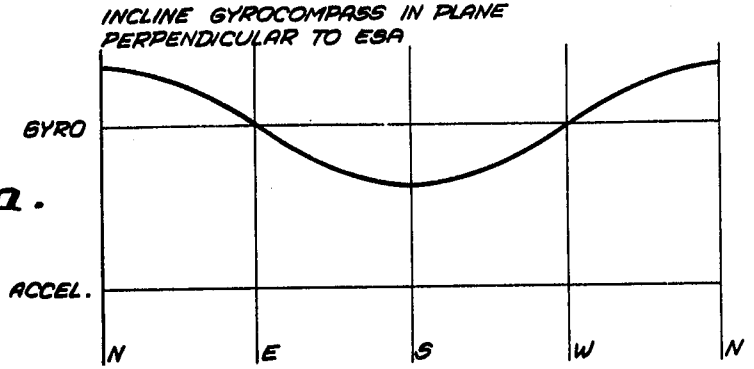
Figure 11B:
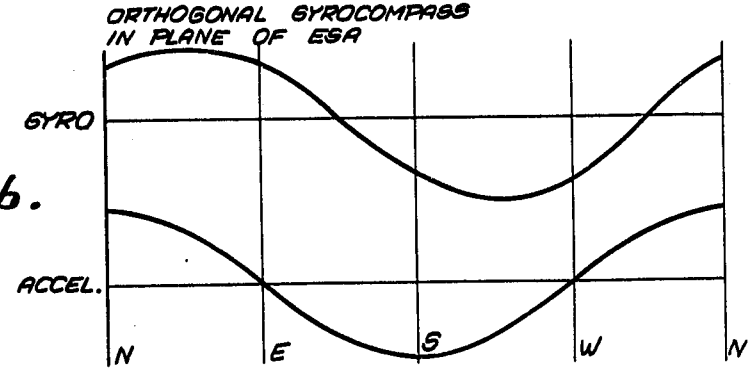
Figure 11C:
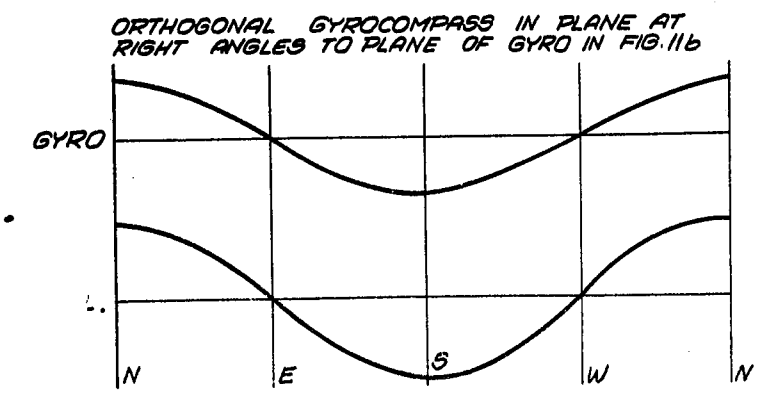
Figure 11:
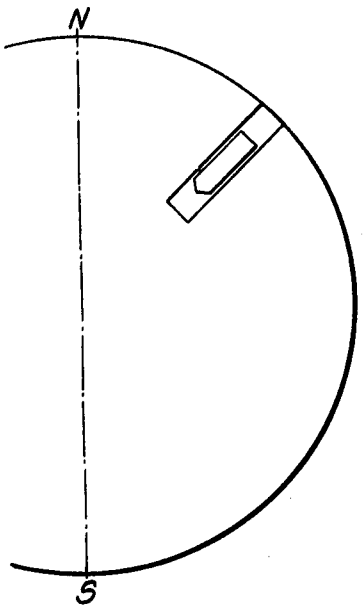

FIGS. 4 and 4*a* are schematic showings of a single degree of freedom gyroscope as may be used in the apparatus of FIG. 1; and FIG. 4*b* is a spin axis component diagram;

FIG. 5 is a diagrammatic showing of the operation of the accelerometer under instrument tilted conditions;

FIG. 6 is a view like FIG. 1, and showing a modified form of the invention;

FIG. 7 is a wave form diagram;

FIG. 8 is a view like FIG. 1, and showing another modified form of the invention;

FIGS. 9 and 9*a* are wave form diagrams showing outputs of a gyroscope and accelerometer, near the earth's pole; and FIGS. 9*b* and 9*c* are wave form diagrams associated with operation of the FIG. 6 modification near the earth's pole;

FIGS. 10 and 10*a* are wave form diagrams showing outputs of a gyroscope and accelerometer near the earth's equator; and FIGS. 10*b* and 10*c* are wave form diagrams associated with operation of the FIG. 6 apparatus near the earths's equator; and FIGS. 11 and 11*a* are wave form diagrams showing outputs of a gyroscope and accelerometer at a location between the earth's pole and equator; and FIGS. 11*b* and 11*c* are wave form diagrams illustrative of the operation of the FIG. 6 apparatus at a latitude between pole and equator.

DETAILED DESCRIPTION

In FIG. 1, well tubing 10 extends downwardly in a well 11, which may or may not be cased. Extending within the tubing in a well mapping instrument or apparatus 12 for determining the direction of tilt, from vertical, of the well or bore-hole. Such apparatus may readily be traveled up and down in the well, as by lifting and lowering of a cable 13 attached to the top 14 of the instrument. The upper end of the cable is turned at 15 and spooled at 16, where a suitable meter 17 may record the length of cable extending downwardly in the well, for logging purposes.

The apparatus 12 is shown to include a generally vertically elongated tubular housing or carrier 18 of diameter less than that of the tubing bore, so that well fluid in the tubing may readily pass, relatively, the instrument as it is lowered in the tubing. Also, the lower terminal of the housing may be tapered at 19, for assisting downward travel or penetration of the instrument through well liquid in the tubing. The carrier 18 supports a rate gyroscope 20, accelerometer 21, and drive means 22 to rotate the latter, for travel lengthwise in the well. Bowed springs 70 on the carrier center it in the spring 10.

The drive means 22 may include an electric motor and speed reducer functioning to rotate a shaft 23 relatively slowly about axis 24 which is generally parallel to the length axis of the tubular carrier, i.e., axis 24 is vertical when the instrument is vertical, and axis 24 is tilted at the same angle from vertical as is the instrument when the latter bears sidewardly against the bore of the tubing 10 when such tubing assumes the same tilt angle due to bore-hole tilt from vertical. Merely as illustrative, the rate of rotation of shaft 23 may be within the range of 0.5 RPM to 5 RPM. The motor and housing may be considered as within the scope of primary means to support and rotate the gyroscope.

Due to rotation of the shaft 23, and a lower extension 23*a* thereof, the frame 25 of the gyroscope and the frame 26 of the accelerometer are both rotated simultaneously about axis 24, within and relative to the sealed housing 18. The signal output of the gyroscope and accelerometer are transmitted via terminals at suitable slip ring structures 25*a* and 26*a*, and via cables 27 and 28, to the processing circuitry at 29 within the instrument, such circuitry for example including a suitable amplifier or amplifiers, and multiplexing means, if desired. The multiplexed or non-multiplexed output from such circuitry is transmitted via a lead in cable 13 to a surface recorder, as for example includes pens 34 and 34*a* of a strip chart recorder 35, whose advancement may be synchronized with the lowering of the instrument in the well. The drivers 60 and 61 for recorder pens 34 and 34*a* are calibrated to indicate bore-hole azimuth and degree of tilt, respectively, the run-out of the strip chart indicating bore-hole depth along its length.

Turning to FIG. 4, the gyroscope 20 is schematically indicated as having its frame 25 rotated about upward axis 24, as previously described. A sub-frame 36 of the gyroscope has shafts 36*a* and 36*b* bearing supported at 37 and 37*a* by the frame 25, to pivot about output axis OA which is canted relative to axis 24, i.e. at cant angle $\alpha$. The gyroscope rotor 39 is suitably motor driven to rotate about spin reference axis SRA which is normal to axis OA. The rotor is carried by sub-frame 36, to pivot therewith and to correspondingly rotate the wiper 41 in engagement with resistance wire 42 connected with DC source 43. The sub-frame 36 is yieldably biased against rotation about axis OA and relative to the housing 25, as by compression springs 75 (or their electrical equivalents) carried by the housing and acting upon the arm 76 connected to shaft 36*a*, as better seen in FIG. 4*a*.

Figure 3:
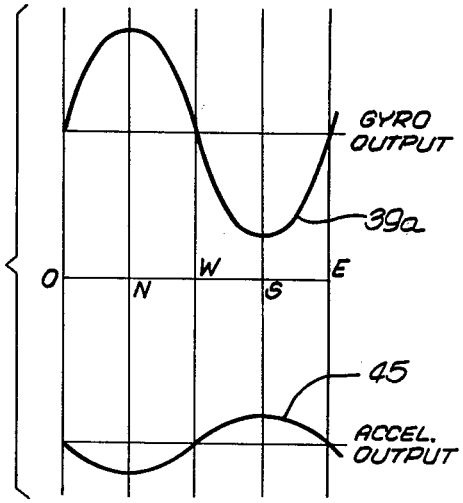
FIG. 3 is a wave form diagram.

Accordingly, the current flow via the wiper is a function or pivoting of the sub-frame 36 about axis OA, which is in turn a function of rotary orientation of the frame 25 with respect to a North-South longitudinal plane through the instrument in the well. As seen in FIG. 3, the gyroscope may be rotated about axis 24 so that its signal output 39*a* is maximized when spin reference axis SRA passes through the North-South longitudinal plane, and is zero when that axis is normal to that plane. One usable gyroscope is model GI-G6, a product of Northrop Corporation.

Figure 2:
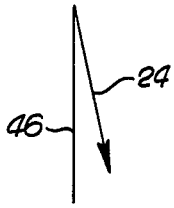
FIG. 2 is a diagram indicating tilt of the well mapping tool in a slanted well.

The accelerometer 21, which is simultaneously rotated with the gyroscope, has an output as represented for example at 45 under tilted conditions corresponding to tilt of axis 24 in North-South longitudinal plane; i.e., the accelerometer output is maximized when the gyroscope output indicates South alignment, and again maximized when the gyroscope output indicates North alignment. FIG. 2 shows tilt of axis 24 from vertical 46, and in the North-South plane, for example. Further, the accelerometer maximum output is a function of the degree of such tilt, i.e. is higher when the tilt angle increases, and vice versa; therefore, the combined outputs of the gyroscope and accelerometer enable ascertainment of the azimuthal direction of bore-hole tilt, at any depth measured lengthwise of the bore-hole, and the degree of that tilt.

FIG. 5 diagrammatically illustrates the functioning of the accelerometer in terms of rotation of a mass 40 about axis 24 tilted at angle $\theta$ from vertical 46. As the mass rotates through points 44 at the level of the intersection of axis 24 and vertical 46, its rate of change of velocity in a vertical direction is zero; however, as the mass rotates through points 47 and 48 at the lowest and highest levels of its excursion, its rate of change of velocity in a vertical direction is at a maximum, that rate being a function of the tilt angle $\theta$. A suitable accelerometer is that known as Model 4303, a product of Systron-Donner Corporation, of Concord, Calif.

Control of the angular rate of rotation of shaft 23 about axis 24 may be from surface control equipment indicated at 50, and circuitry 29 connected at 80 with the motor. Means (as for example a rotary table 81) to rotate the drill pipe 10 during well mapping, as described, is shown in FIG. 1.

Referring to FIGS. 1 and 7, the gyroscope is characterized as producing an output which varies as a function of azimuth orientation of the gyroscope relative to the earth's spin axis, that output for example being indicated at 109 in FIG. 7 and peaking when North is indicated. Shaft 23 may be considered as a motor rotary output element which may transmit continuous unidirectional drive to the gyroscope. Alternatively, the shaft may transmit cyclically reversing rotary drive to the gyroscope. Further, the structure 22 may be considered as including servo means responsive to the gyroscope output to control the shaft 23 so as to maintain the gyroscope with predetermined azimuth orientation, i.e. the axis SRA may be maintained with direction such that the output 109 in FIG. 7 remains at a maximum or any other desired level.

Also shown in FIG. 1 is circuitry 110, which may be characterized as a position pick-off, for referencing the gyroscope output to the case or housing 18. Thus, that circuitry may be connected with the motor (as by wiper 111 on shaft 23*a*′ turning with the gyroscope housing 20 and with shaft 23), and also connected with the carrier 18 (as by slide wire resistance 112 integrally attached to the carrier via support 113), to produce an output signal at terminal 114 indicating azimuthal orientation of the gyroscope relative to the carrier. That output also appears at 115 in FIG. 7. As a result, the outputs at terminal 114 may be processed (as by surface means generally shown at 116 connected to the instrumentation by cable 13) to determine or derive azimuthal data indicating orientation of the carrier relative to the earth's spin axis. Such information is often required, as where it is desired to know the orientation of well logging apparatus being run in the well. Item 120 in FIG. 1 may be considered, for example, as well logging apparatus the output of which appears at 121. Carrier 18 supports item 120, as shown. Merely for purpose of illustration, such apparatus may comprise an inclinometer to indicate the inclination of the bore-hole from vertical, or a radiometer to sense radiation intensity in the hole.

It will be understood that the recorder apparatus may be at the instrument location in the hole, or at the surface, or any other location. Also, the control of the motor 29 may be pre-programmed or automated in some desired manner.

Referring to FIGS. 1, 4 and 4*b*, the result of canting the gyroscope 20 as shown is the production of rotor spin axis components shown at 130 and 131 in FIG. 4*b*. Thus the rotor may be considered as spinning about two component axes 130 and 131. Axis component 130 is parallel to travel axis 24, and axis component 131 is normal to axis 24. Also, axis OA thus describes cones about axis 24, as the instrument is rotated, and therefore may never become aligned with the earth's spin axis. Accordingly, if the instrument is used at or near the earth's spin axis pole, in a bore-hole substantially parallel to the earth's spin axis, the gyroscope's input derived from the earth's rate of turn will not approach zero, but will be some finite nominal value plus earth spin rate which is a function of the angle $\alpha$, and the component of earth spin rate.

Canting of the gyroscope as little as 10° ($\alpha = 10°$) has the effect coupling in the sine of $10° \times 36°$ degrees/minute$\times$60 minutes/hr, or nearly 2,200 degrees per hour, for example, in the gyroscope signal output.

The form of the invention shown in FIG. 6 includes two rate of turn gyroscopes 150 and 151 located within and supported by a carrier housing 180 corresponding to housing 18 in FIG. 1. The first gyroscope 150 is operatively connected with the drive motor 153 via shaft 154 for rotation about shaft axis 155 which corresponds to the instrument travel axis. The second gyroscope is operatively connected with a second drive motor 153*a* via lateral shaft 156, gears 157 and 158 and lateral shaft 159, for rotation about a secondary lateral axis 160, normal to axis 155. Both motors 153 and 153a and the carrier 180 may be considered as included within the scope of primary means to support the gyroscopes for rotation about their respective axes, and for travel along the instrument travel axis.

The gyroscope 150 has a spin rotor 161 with a spin axis 162 which remains normal to axis 155; and the second gyroscope 151 has a spin rotor 163 with a spin axis 164 which remains generally parallel or coincident with the travel axis 155. Gyroscope 150 also includes a main frame 166 and a sub-frame 167 supported by shaft means 168 for rotation relative to the main frame about axis 169 parallel to axis 155 (these elements corresponding to elements 25, 36 and 36a in FIG. 4); and gyroscope 151 also includes a main frame 170 and a sub-frame 171 supported by shaft means 172 for rotation relative to the main frame about axis 160 normal to axis 155.

Springs 173 and 174 respectively resist such rotation of the sub-frames 167 and 171. Potentiometer circuitry 175 (corresponding to that at 41–43 in FIG. 4) is associated with shaft means 168 and main frame 166 to sense rotation of sub-frame 167 relative to main frame 166; and similar potentiometer circuitry 176 is associated with shaft means 172 and main frame 170 to sense rotation of sub-frame 171 relative to main frame 170. Either or both outputs (at 175a and 176a) of these circuits can be processed by electronics 300 and recorded, depending upon the inclination of the bore-hole relative to the earth's spin axis, so that earth's rate of rotation can always be detected, i.e. the all-attitude, all latitude performance advantage. Data redundancy is also achieved, as previously mentioned.

FIG. 6 also illustrates the provision of an accelerometer or inclinometer 178 (corresponding to accelerometer 21) driven by shaft 154a attached to gyroscope frame 166; and optional accelerometer 185 connected via gear 186 to gear 158, so as to be driven by motor 153a about a lateral axis 187 parallel to axis 160. Accelerometer or tilt sensor 178 produces an output at 301 which varies as a function of rotation of gyroscope 150 (by motor 153) and of tilt thereof from vertical; and accelerometer or tilt sensor 185 has an output at 302 which varies as a function of rotation of gyroscope 151 by motor 153a and of tilt thereof from horizontal. In addition, shaft angle pick-offs or potentiometers are shown at 188 and 189 to sense rotation of the outputs of motors 153 and 153a relative to the carrier 180, in a manner similar to the functioning of detection structure 110–113 in FIG. 1.

Referring to FIG. 8, the gyroscope means includes rate-of-turn gyroscope structure 200 operatively connected with primary means (that includes azimuth drive motor 201 and support housing 202) for rotation about the travel axis 203 as well as the coincident instrument axis, and also for rotation about a secondary axis 204 which is normal to axis 203 and extends laterally as shown. The primary means in this example also includes "elevation" drive motor 205 which functions to rotate the gyroscope about axis 204. First drive mechanism associated with motor 201 is shown to include a yoke 206 rotatable about axis 203, and having an arm 206a carrying the second motor 205 offset from axis 203 so as to be rotated about the latter.

The adjustable gyroscope means 200 has one position corresponding to the position of gyroscope 150 in FIG. 6, with a corresponding output obtained in response to rotation about axis 203 by motor 201; and it has another 90° rotated position corresponding to that of gyroscope 151 in FIG. 6, with a corresponding output obtained in response to rotation about lateral axis 204 by motor 205. A suitable circuit is indicated generally at 210 for producing such outputs which vary as functions of changes in azimuth orientations of the spin axes of the gyroscope means 200 (as respects its two positions), relative to the earth's spin axis, such outputs providing the all-attitude, all latitude advantages referred to above. In addition, shaft angle pick-off circuits are provided at 213 and 214 for producing outputs which vary as functions of gyroscope carrier frame rotation (or motor shaft rotation) relative to the support housing 202 (i.e. about axis 203 and 204). One usable gyroscope 200 is Model NF 5018 produced by Electronic Specialty Company, Portland, Oreg.

Suitable tilt sensor devices, represented by accelerometer means 220, may be carried in association with the gyroscopic means 200 as shown, to produce outputs varying as functions of rotation about axis 203 and 204, and of tilt of axis 203 relative to vertical and of tilt of axis 204 relative to horizontal.

The method of the invention, broadly considered, is that referred to in the introduction, and also as described more in detail, above.

The wave forms of FIGS. 9a–9c; 10a–10c; and 11a–11c will now be described:

FIG. 9a shows the in-line gyroscope and accelerometer outputs (as for gyro 150 and accelerometer 178 in FIG. 6) operating in a vertical bore-hole near the earth's pole. See also FIG. 9. FIG. 9b shows outputs of the gyroscope 151 and accelerometer 185 of FIG. 6, operating as in FIG. 9; and FIG. 9c is like FIG. 9b except that the gyroscope 151 is then rotated 90° so that its spin axis 164 is perpendicular to the plane of FIG. 6.

FIG. 10a shows the in-line gyroscope and accelerometer outputs (as for gyro 150 and accelerometer 178 in FIG. 6) operating in a vertical bore-hole near the earth's equator. See also FIG. 10. FIG. 10b shows outputs of the gyroscope 151 and accelerometer 185 of FIG. 6 operating as in FIG. 10; and FIG. 10c is like FIG. 10b, except that the gyroscope 151 is then rotated 90° so that its spin axis 164 is perpendicular to the plane of FIG. 6.

FIGS. 11, 11a, 11b and 11c correspond to FIGS. 10, 10a 10b and 10c, except that the gyroscope and accelerometer of FIG. 6 are operated at a latitude between the earth's pole and equator.

Thus, the output curves or "signatures" are unique for any latitude and attitude.

A further method of operation may be summarized as follows:

(a) suspending at a remote zone (as for example in a bore-hole) a rate-of-turn gyroscope having a spin rotor and a carrier frame for the rotor, (b) rotating the carrier frame about an axis (which may for example be parallel to or nearly parallel to the earth's spin axis) in an effort to produce a varying signal output from the gyroscope, and (c) determining that the absence or substantial absence of such output is indicative of the alignment or near alignment of said axis with the earth's spin axis.

The method may be carried out for example by use of gyroscope 150 in FIG. 6, alone.

I claim:

1. In apparatus for determining azimuth, the combination that comprises (a) rate-of-turn gyroscope means including a main frame and a sub-frame carrying spin rotor means, (b) primary means to support the gyroscope means for lengthwise travel along a travel axis, and to be rotated, the spin rotor means having substantial spin axis components along said travel axis and in a direction normal to said travel axis, the quotient of said spin axis component along the travel axis divided by the spin axis component normal to said travel axis being the tangent of an angle which is at least about 10°, (c) said primary means connected with the main frame to continuously and unidirectionally rotate the main frame about the travel axis independently of the position of the sub-frame relative to the main frame, said travel axis intersecting the gyroscope means.

2. The combination of claim 1 wherein the gyroscope means comprises one rate-of-turn gyroscope supported by said primary means for rotation about said travel axis.

3. The combination of claim 2 wherein said spin rotor means comprises one spin rotor having one spin axis which remains at an acute angle to said travel axis as the gyroscope is rotated about said travel axis.

4. The combination of claim 3 wherein said primary means includes a motor operatively connected with the rate-of-turn gyroscope to rotate it about said travel axis.

5. The combination of claim 4 wherein said primary means includes a housing supporting and containing said motor and gyroscope.

6. The combination of claim 4 wherein said rate-of-turn gyroscope main frame is connected to the motor to be rotatable by the motor.

7. The combination of claim 1 including circuitry for producing an output which varies as a function of azimuth orientation of a spin axis component relative to the earth's spin axis.

8. The combination of claim 6 including circuitry for producing an output which varies as a function of azimuth orientation of a spin axis component relative to the earth's spin axis.

9. In apparatus for determining azimuth, the combination that comprises:

(a) rate-of-turn gyroscope means including spin rotor means, (b) primary means to support the gyroscope means for simultaneous travel along a travel axis, and to be rotated, (c) the gyroscope means including a first rate-of-turn gyroscope operatively connected with said primary means for rotation about said travel axis, and a second rate-of-turn gyroscope operatively connected with the primary means for rotation about a secondary axis normal to the travel axis, (d) each gyroscope having means for producing an output which varies as a function of said rotation of that gyroscope.

10. The combination of claim 9 wherein said spin rotor means comprises a first spin rotor associated with said first gyroscope and having a spin axis which remains normal to said travel axis, and said spin rotor means also comprises a second spin rotor associated with said second gyroscope and having a spin axis which remains generally parallel to or coincident with said travel axis.

11. The combination of claim 10 wherein said primary means comprises drive motor means including first drive mechanism operatively connected with the first gyroscope to rotate it about said travel axis, and a second drive mechanism operatively connected with the second gyroscope to rotate it about said secondary axis.

12. The combination of claim 11 wherein said primary means includes a housing supporting and containing said motor means, drive structures and gyroscopes.

13. The combination of claim 11 wherein each gyroscope includes a carrier frame and a sub-frame, the gyroscope spin rotor carried by said sub-frame, the first gyroscope carrier frame rotatable by the first drive mechanism, and the second gyroscope carrier frame rotatable by the second drive mechanism.

14. The combination of claim 13 including circuitry for producing outputs which vary as functions of changes in azimuth orientation of said spin axes relative to the earth's spin axis.

15. The combination of claim 13 including other circuitry for producing outputs which vary as functions of gyroscope carrier frame rotation relative to a housing supporting the gyroscopes.

16. The combination of claim 11 including a tilt sensing device associated with said first gyroscope to be rotated therewith and to produce an output which varies as a function of rotation of the first gyroscope and of tilt thereof from vertical.

17. The combination of claim 16 including another tilt sensing device indicated with said second gyroscope to be rotated therewith and to produce an output which varies as a function of said rotation of the second gyroscope and of tilt thereof from horizontal.

18. In apparatus for determining azimuth, the combination that comprises:

(a) a rate-of-turn gyroscope including spin rotor having a spin axis, (b) primary means to support the gyroscope for travel along a travel axis, for rotation in a first mode about the travel axis, and for rotation in a second mode about a secondary axis normal to the travel axis, (c) and circuitry operatively connected to the gyroscope for producing outputs which vary as a function of changes in azimuth orientation of said spin axis relative to the earth's spin axis.

19. The combination of claim 18 wherein said primary means comprises drive motor means including first drive mechanism to rotate the gyroscope structure about said travel axis, and second drive mechanism to rotate the gyroscope structure about said secondary axis, the second drive mechanism operatively connected with the first drive mechanism to be rotated thereby.

20. The combination of claim 19 wherein said first drive mechanism includes a yoke rotatable about said travel axis, said second drive mechanism carried by an arm defined by the yoke.

21. The combination of claim 19 including other circuitry for producing outputs which vary as function of gyroscope carrier frame rotation relative to a housing supporting the gyroscope means.

22. The method of mapping a remote zone, that includes (a) suspending at said zone a rate-of-turn gyroscope means having a main frame and a sub-frame carrying spin rotor means with spin axis components along first and second orthogonal axes, said main frame adapted for travel along a travel axis which intersects the gyroscope means, said suspending carried out to orient said components along and normal to said travel axis and to provide a quotient of said spin axis component along the travel axis divided by the spin axis component normal to said travel axis, which quotient is the tangent of an angle which is at least about 10°, (b) and continuously and unidirectionally rotating the main frame about said travel axis and in conjunction with rotation of the spin rotor means, to produce a signal or signals indicative of azimuth orientation of at least one of said spin axis components relative to the earth's spin axis.

23. The method of mapping a remote zone, that includes:

(a) suspending at the remote zone a rate-of-turn gyroscope having a main frame and a sub-frame carrying a spin rotor with spin axis components along first and second orthogonal axes, said main frame adapted for travel along a travel axis which intersects the gyroscope means, said suspending carried out to orient said components along and normal to said travel axis and to provide a quotient of said spin axis component along the travel axis divided by the spin axis component normal to said travel axis, which quotient is the tangent of an angle which is at least about 10°, (b) continuously and unidirectionally rotating the main frame about said travel axis independently of the position of the sub-frame relative to the main frame in an effort to produce a varying signal output from the gyroscope, and (c) determining that the absence or substantial absence of such output is indicative of the alignment or near alignment of said travel axis with the earth's spin axis.

24. In apparatus for determining azimuth, the combination that includes:

(a) rate-of-turn gyroscope means including a main frame and a sub-frame carrying spin rotor means, (b) primary means to support the gyroscope means for lengthwise travel along a travel axis, and to be rotated, the spin rotor means having substantial spin axis components along said travel axis and in a direction normal to said travel axis, the quotient of said spin axis component along the travel axis divided by the spin axis component normal to said travel axis being the tangent of a substantial preselected angle, (c) said primary means connected with the main frame to continuously and unidirectionally rotate the main frame about the travel axis independently of the position of the sub-frame relative to the main frame, said travel axis intersecting the gyroscope means.

* * * * *